US010106937B2

(12) United States Patent
Hedstrom

(10) Patent No.: US 10,106,937 B2
(45) Date of Patent: Oct. 23, 2018

(54) COLLAPSIBLE ROTOR DRIVETRAIN

(71) Applicant: Caterpillar Paving Products Inc., Brooklyn Park, MN (US)

(72) Inventor: Craig Hedstrom, Mounds View, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 64 days.

(21) Appl. No.: 15/254,616

(22) Filed: Sep. 1, 2016

(65) Prior Publication Data

US 2018/0058018 A1 Mar. 1, 2018

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS 4,929,121 A * 5/1990 Lent ..... E01C 23/088 299/1.5
4,986,604 A * 1/1991 Meister ..... E01C 23/088 299/39.4
5,879,056 A * 3/1999 Breidenbach ..... E01C 23/088 299/1.5
7,644,994 B2 1/2010 Wirtgen
8,632,132 B2 1/2014 Wirtgen
8,770,668 B2 * 7/2014 Hall ..... E01C 23/088 29/426.1
2012/0243939 A1 * 9/2012 Oxford ..... E01C 23/088 404/90
2012/0284989 A1 * 11/2012 Busley ..... E01C 23/088 29/428
2014/0265525 A1 * 9/2014 Schafer ..... E01C 23/088 299/39.1
2016/0040371 A1 * 2/2016 Roetsch ..... E01C 23/088 299/39.4

(Continued)

FOREIGN PATENT DOCUMENTS

DE 102006020663 A1 10/2007
DE 102013004234 A1 9/2014

*Primary Examiner* — David J Bagnell
*Assistant Examiner* — Michael A Goodwin
(74) *Attorney, Agent, or Firm* — Miller, Matthias & Hull

(57) ABSTRACT

A rotor assembly for a cold planer is disclosed. The rotor assembly may include a rotor chamber that is configured to house a milling drum, and the milling drum may be configured to rotate within the rotor chamber. The rotor assembly may further include a plate movably coupled to the rotor chamber and an upper pulley wheel rotatably mounted to the plate. Furthermore, a lower pulley wheel may be rotatably mounted to the rotor chamber and the lower pulley wheel may be operably coupled to the milling drum such that the lower pulley wheel and the milling drum synchronously rotate. The rotor assembly may further include an actuating mechanism operably coupled to the plate, and the actuating mechanism may be configured to move the plate and the upper pulley wheel between an operation position and a transport position.

20 Claims, 4 Drawing Sheets

(56) References Cited

U.S. PATENT DOCUMENTS

| | | | | |
|---|---|---|---|---|
| 2016/0040372 | A1* | 2/2016 | Eiden | E01C 23/088<br>29/426.1 |
| 2017/0130407 | A1* | 5/2017 | Laux | B62D 65/02 |
| 2017/0268637 | A1* | 9/2017 | Musil | F16H 7/0827 |

* cited by examiner

COLLAPSIBLE ROTOR DRIVETRAIN

FIELD OF THE DISCLOSURE

The present disclosure relates generally to rotor drivetrains and, more particularly, relates to a collapsible rotor drivetrain.

BACKGROUND OF THE DISCLOSURE

Work machines, such as cold planers and the like are used in road construction and pavement resurfacing. During road construction cold planers operate along a roadway or other paved surface to remove at least a portion of the existing pavement and provide a smooth level surface for the new pavement. However, some cold planers are not configured to be driven long distances on highways, expressways, or other such roadways, and as a result these cold planers may need to be independently transported from one work site to another work site. For example, a cold planer may be loaded onto a trailer and transported to the work site by a truck, locomotive or other such transport vehicle. Additionally, some cold planers, may be too large to transport on a single transport vehicle. As a result, the cold planer may be partially disassembled with the individual components loaded onto multiple transport vehicles and transported to the desired location.

During transportation, the individual components of the cold planer may need to comply with certain shipping and transportation regulations. For example, shipments transported over highways, expressways and other roadways may be subject to maximum weight, maximum height, maximum width, maximum length, or other such transportation regulations. Therefore, each component of the cold planer may need to be loaded onto a trailer or other transport vehicle and oriented to comply with the various transportation regulations. In some situations the cold planer components, such as but not limited to, the rotor assembly, may be too large (i.e., over the maximum width and maximum length limits) to comply with all of the transportation regulations. As a result, these non-compliant components may require a special permit in order to transport the components using standard transportation routes along highways, expressways, or other such roadways. Alternatively, the non-compliant components may need to be further disassembled in order to comply with the transportation regulations.

A construction machine for the milling of road surfaces is disclosed in U.S. Pat. No. 7,644,994 entitled, "Construction Machine for Machining Floor Surfaces," (the '994 patent). The construction machine disclosed therein is equipped with exchangeable tools for removing road surfaces. At the end of their serviceable life, the exchangeable tools arranged around the machine must be replaced with new tools. To facilitate the replacement of the exchangeable tools, the '994 patent further includes a controllable auxiliary drive that is coupled to the main drive line of the construction machine. The auxiliary drive positions a work drum of the machine in a raised position so that the exchangeable tools are disengaged with the ground surface. Additionally, the auxiliary drive is able to rotate and advance the work drum so a next row of exchangeable tools can be positioned in a convenient mounting position for the operator performing the exchangeable tool replacement.

While arguably effective for the replacement of the exchangeable tools, the '944 patent does not provide an adjustable rotor assembly which complies with transportation restrictions and therefore allows transportation of the rotor assembly without the need for special permitting.

SUMMARY OF THE DISCLOSURE

In accordance with one embodiment, a rotor assembly for a cold planer is disclosed. The rotor assembly may include a rotor chamber that is configured to house a milling drum, and the milling drum may be configured to rotate within the rotor chamber. The rotor assembly may further include a plate movably coupled to the rotor chamber and an upper pulley wheel rotatably mounted to the plate. Furthermore, a lower pulley wheel may be rotatably mounted to the rotor chamber and the lower pulley wheel may be operably coupled to the milling drum such that the lower pulley wheel and the milling drum synchronously rotate. The rotor assembly may further include an actuating mechanism operably coupled to the plate, and the actuating mechanism may be configured to move the plate and the upper pulley wheel between an operation position and a transport position.

In accordance with another embodiment, a cold planer is disclosed. The cold planer may include a frame, a power source supported by the frame, and a plurality of ground engaging members configured to support the frame. The ground engaging members may be operatively coupled to the power source and configured to move the cold planer. The cold planer may further include a rotor assembly removably attached to the frame. The rotor assembly of the cold planer may further include a rotor chamber configured to house a milling drum, and the milling drum may be further configured to rotate within the rotor chamber. A plate may be movably coupled to the rotor chamber and an upper pulley wheel may be rotatably mounted to the plate. The rotor assembly of the cold planer may further include a drive shaft coupled to the upper pulley wheel and the drive shaft being driven by the power source to rotate the upper pulley wheel. Moreover, a lower pulley wheel may be mounted to the rotor chamber and operably coupled to the milling drum such that the lower pulley wheel and the milling drum synchronously rotate. Additionally, an actuating mechanism may be operably coupled to the plate and the rotor chamber and the actuating mechanism may be configured to move the plate and the upper pulley wheel between an operation position and a transport position. The cold planer may further include a controller communicably coupled with the actuating mechanism and configured to transmit a control signal to the actuating mechanism wherein the transmitted control signal activates the actuating mechanism to move the plate and the upper pulley wheel between the operation position and the transport position.

In accordance with yet another embodiment, a method transporting a cold planer having a rotor assembly is disclosed. The method may include removing a belt from an upper pulley wheel and a lower pulley wheel of the rotor assembly, and the upper pulley wheel is rotatably coupled to a plate. The method may further include, decoupling a drive shaft from the upper pulley wheel thereby disconnecting the upper pulley wheel from a power source of the cold planer. The method may include activating an actuating mechanism to move the plate and the upper pulley wheel from an operation position to a transport position and locking the plate and the upper pulley in the transport position. The method may further include removing a plurality of attachment devices from the rotor chamber thereby decoupling the rotor assembly from the cold planer. Finally the method may include loading the rotor assembly onto a transportation vehicle to transport the rotor assembly to a desired location.

These and other aspects and features of the present disclosure will be more readily understood upon reading the following detailed description in conjunction with the accompanying drawings.

DETAILED DESCRIPTION

Figure 1:
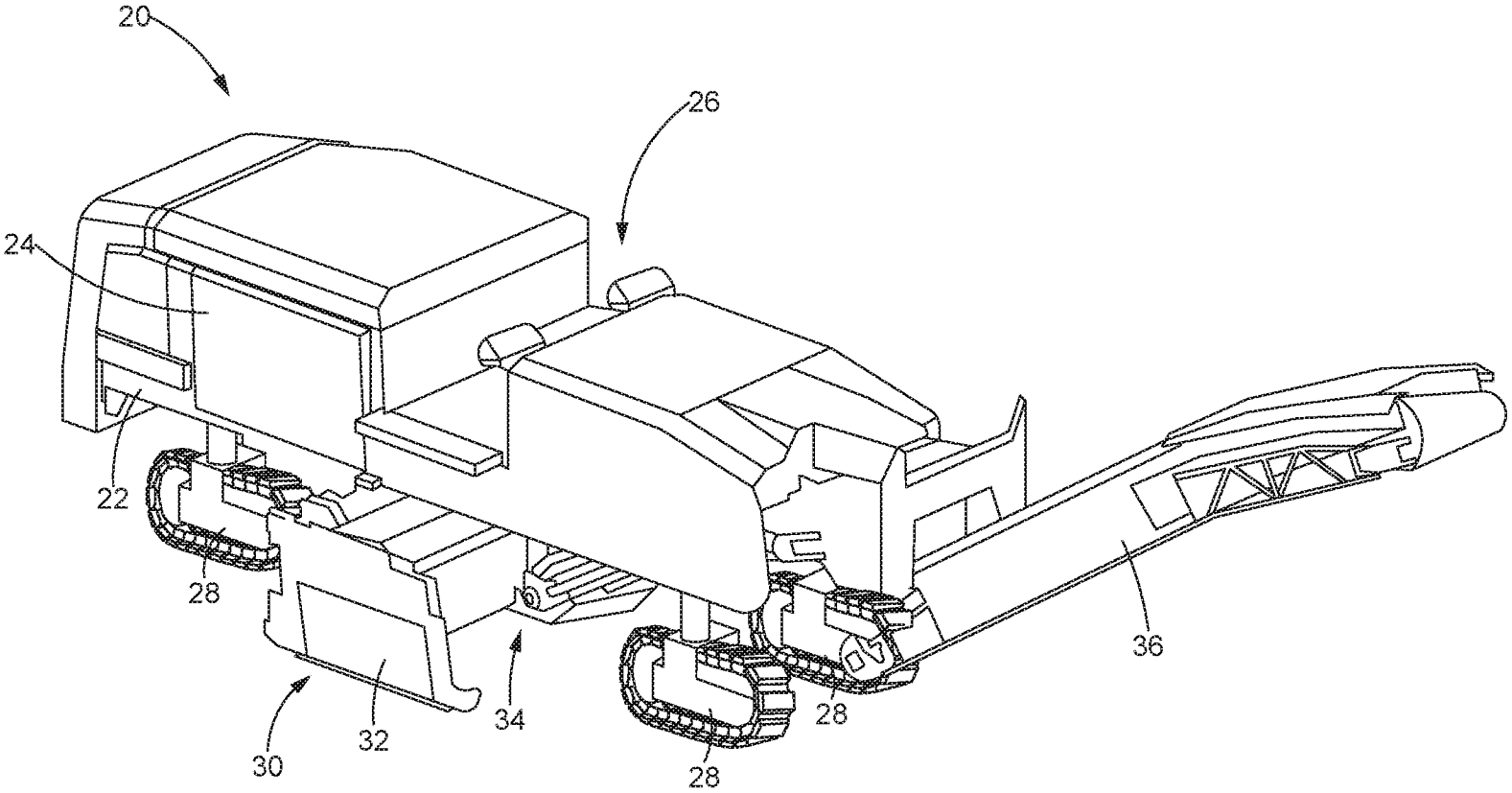
FIG. 1 is a perspective side view of a cold planer, in accordance with an embodiment of the present disclosure.

Referring now to the drawings and with specific reference to FIG. 1, a cold planer 20 is shown, in accordance with certain embodiments of the present disclosure. The cold planer 20 may include a frame 22 that supports a power source 24 and an operator platform 26. The cold planer 20 may further include a set of ground engaging members 28 that are rotatably connected to the frame 22 and driven by the power source 24 to propel the cold planer 20 in a direction of movement. Although the set of ground engaging members 28 are shown as continuous tracks, other types of traction devices, such as wheels and the like, may be used. Additionally, the cold planer 20 may include a rotor assembly 30 operatively coupled to the frame 22 of the cold planer 20. The rotor assembly 30 itself may include a rotor chamber 32 and a milling drum 34, which is rotatably housed within the rotor chamber 32 and configured to mill or grind material such as but not limited to, concrete, asphalt, gravel, dirt, stone, or other such material. Furthermore, the rotor assembly 30 may be operatively coupled to the power source 24 such that the power source 24 drives or rotates the milling drum 34. Additionally, the cold planer 20 may include a conveyor 36 or other such machine implement that is configured to transport the material milled or ground by the rotor assembly 30 to a repository such as but not limited to, a dump truck or the like. It is to be understood that the cold planer 20 is shown primarily for illustrative purposes to assist in disclosing features of various embodiments of the present disclosure, and that FIG. 1 may not depict all of the components of a cold planer machine.

Figure 2:
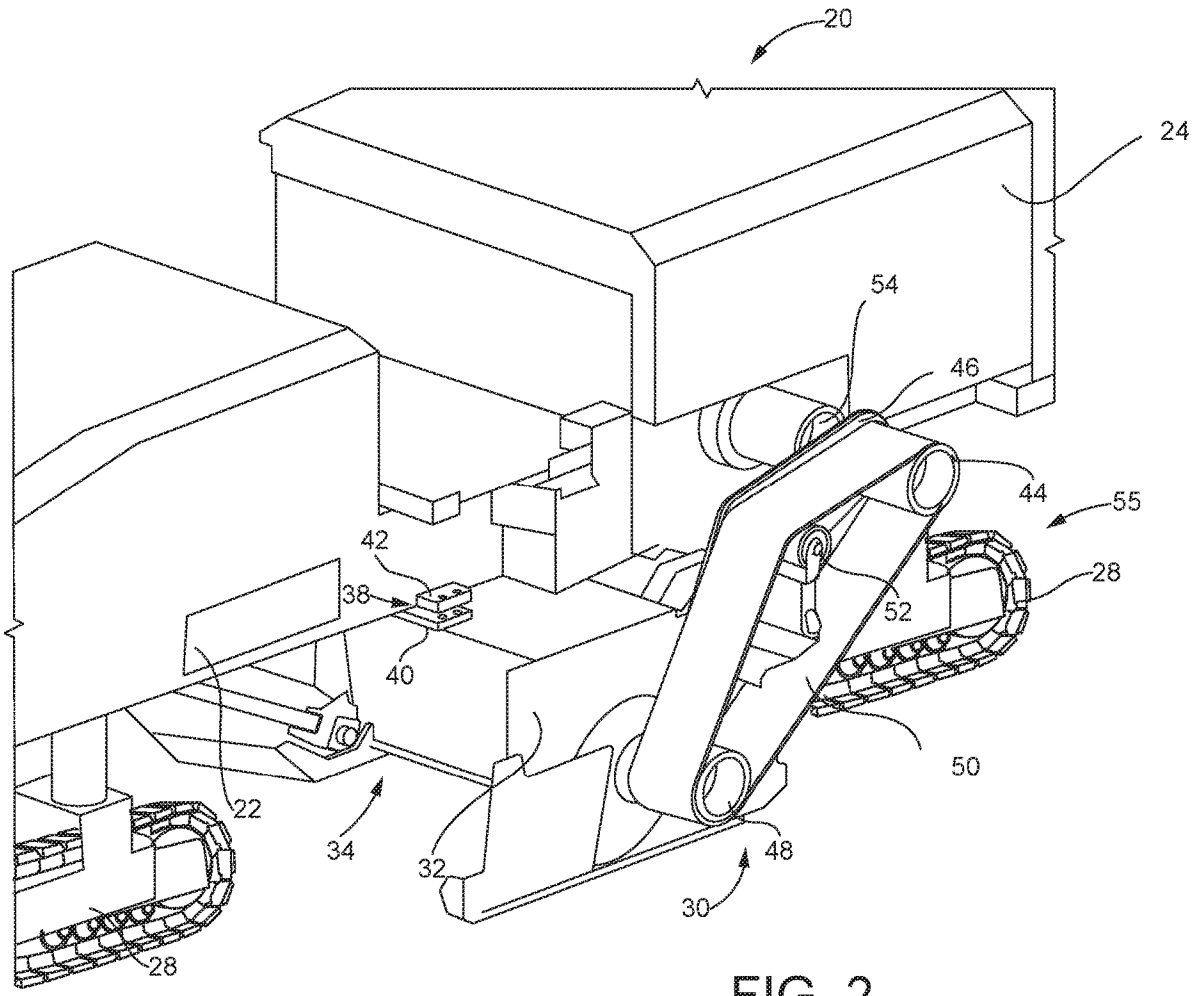
FIG. 2 is an enlarged, perspective side view of the rotor assembly of the cold planer of FIG. 1, in accordance an embodiment of the present disclosure.

Referring now to FIG. 2, with continued reference to FIG. 1, an enlarged perspective view of the rotor assembly 30 operably coupled to the cold planer 20 is shown. In some embodiments, the rotor assembly 30 is removably attached to the frame 22 at plurality of attachment locations 38. For example, the plurality of attachment locations 38 may include a rotor attachment bracket 40 and a corresponding frame attachment bracket 42, and at least one attachment device (not shown) such as, a bolt, pin, screw, or other such device. The attachment device may be inserted into the rotor attachment bracket 40 and the frame attachment bracket 42 and tightened or otherwise secured, to attach the rotor assembly 30 to the frame 22 of the cold planer 20. In some embodiments, the rotor assembly 30 may be detached or otherwise removed from the frame 22 by removing the at least one attachment device from the rotor attachment bracket 40 and the frame attachment bracket 42. Once all of the attachment devices and other assembly connections (i.e., hoses, belts, wires, etc.) are removed or disconnected, the rotor assembly 30 may be separated from the frame 22.

In some embodiments, the rotor assembly 30 further includes an upper (drive) pulley wheel 44 rotatably coupled to a movable drivetrain mounting plate 46, and a lower (driven) pulley wheel 48 rotatably coupled to the rotor chamber 32. The upper pulley wheel 44 and the lower pulley wheel 48 may be operably coupled with a belt 50, or other such device. Additionally, the rotor assembly 30 may include at least one belt tensioner 52 configured to adjust the tension and alignment of the belt 50 between the upper pulley wheel 44 and the lower pulley wheel 48. In one non-limiting example, the upper pulley wheel 44 is operably coupled to the power source 24 by a drive shaft 54 and the power source 24 drives the drive shaft 54 causing the upper pulley wheel 44 to rotate. As a result, the rotation of the upper pulley wheel 44 drives the rotation of the lower pulley wheel 48. Furthermore, the lower pulley wheel 48 may be operably coupled to the milling drum 34 and as a result, the rotation of the lower pulley wheel 48 rotates the milling drum 34. In some embodiments, the upper pulley wheel 44, the drivetrain mounting plate 46, and the belt 50, may collectively be referred to as the drivetrain 55 of the rotor assembly 30.

Figure 3:
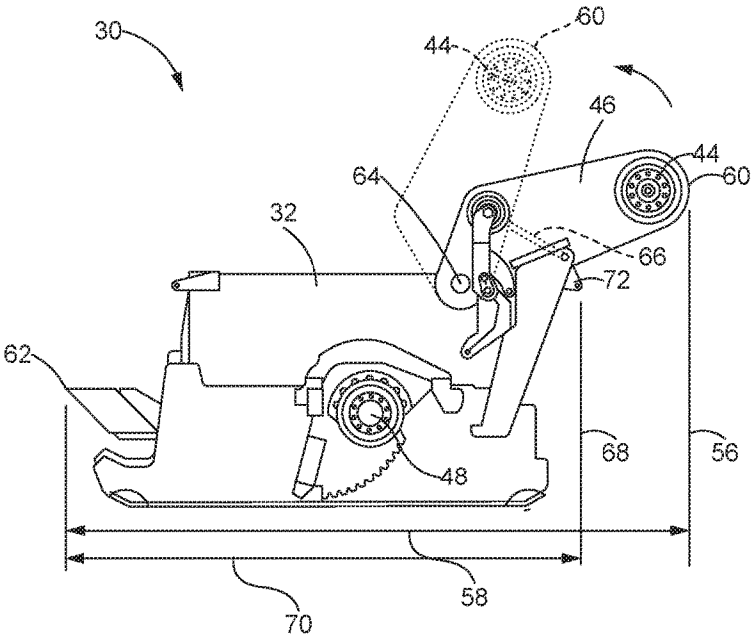
FIG. 3 is a side view of the rotor assembly actuated between an operation position and a transportation position, in accordance with an embodiment of the disclosure.

Referring to FIG. 3, with continued reference to FIGS. 1-2, a side view of the rotor assembly 30 is shown. In some embodiments, the rotor assembly 30 is capable of being adjusted into one or more positions to increase or decrease a dimension or geometry of the rotor assembly 30. Such dimensions and geometries may include but are not limited to, the width, length, height, or other such dimension of the rotor assembly 30. For example, in FIG. 3 the drivetrain mounting plate 46 and the upper pulley wheel 44 may be adjusted into an operation position 56 of the rotor assembly 30. In the operation position 56, the drivetrain mounting plate 46 and the upper pulley wheel 44 may be positioned such that the front portion 60 of the drivetrain mounting plate 46 extends in a forward direction beyond the front portion 72 of the rotor chamber 32 to define an operation width 58 of the rotor assembly 30. Accordingly, the operation width 58 may be measured between the front portion 60 of the drivetrain mounting plate 46 and the upper pulley wheel 44 and the rear portion 62 of the rotor chamber 32. However, the measurement of the operation width 58 may be made between alternative points to provide an accurate operation width 58 measurement. In one non-limiting example the operation width 58 measures approximately 3.4 meters, however other configurations of the rotor assembly 30 may provide an alternative operation width 58.

As further shown in FIG. 3, some embodiments of the rotor assembly 30 may also include a pivot joint 64 which pivotally couples or otherwise attaches the drivetrain mounting plate 46 and the upper pulley wheel 44 to the rotor chamber 32. Moreover, an actuation device 66, such as but not limited to, a hydraulic cylinder may be attached to the drivetrain mounting plate 46 and the rotor chamber 32. The actuation device 66 may be configured to actuate the drivetrain mounting plate 46 and the upper pulley wheel 44 which pivots about the pivot joint 64. In one non-limiting example, contraction or other such actuation of the actuation device 66 may pivot or otherwise position the drivetrain mounting plate 46 and upper pulley wheel 44 into the rotor assembly operation position 56. Alternatively, extension or other such actuation of the actuation device 66 may pivot or otherwise position the drivetrain mounting plate 46 and the upper pulley wheel 44 into a rotor assembly transport position 68. In some embodiments, when the drivetrain mounting plate 46 is in the transport position 68 the front portion 60 of the drivetrain mounting plate 46 assumes a more vertical or upright position relative to the rotor chamber 32.

In one non-limiting example, extension or other such actuation of the actuation device 66 may pivot or otherwise rotate the drivetrain mounting plate 46 and the upper pulley wheel 44 from the operation position 56 to the transport position 68. As a result, the front portion 60 of the drivetrain mounting plate 46 may be moved upwards and backwards towards the rear portion 62 of the rotor assembly 30 such that the overall width of the rotor assembly 30 is reduced. For example, as illustrated with the arrow shown in FIG. 3 the actuation device 66 may extend or otherwise actuate to pivot the drivetrain mounting plate 46 and upper pulley wheel 44 in a counterclockwise direction from the front portion 72 of the rotor chamber 32 towards the rear portion 62 of the rotor assembly 30. In some embodiments, the actuation of the drivetrain mounting plate 46 and upper pulley wheel 44 from the operation position 56 to the transport position 68 may thereby reduce the overall width of the rotor assembly 30. As a result, the rotor assembly transport position 68 may define a transport width 70 of the rotor assembly 30 measured between the front portion 72 of the rotor chamber 32 and the rear portion 62 of the rotor chamber 32. In some embodiments, the transport width 70 may measure 2.9 meters, approximately a 14% reduction in width relative to the operation width 58. However other transport widths 70 of the rotor assembly 30, and width reductions thereof are possible to configure the rotor assembly 30 and comply with transportation and shipping regulations.

Furthermore, it will be understood that the rotor assembly 30 may be alternatively or additionally configured to be manually actuated between the operation position 56 and the transport position 68. In some embodiments, known manual actuation devices such as but not limited to, a lever may be used to actuate the drivetrain mounting plate 46 and upper pulley wheel 44. Additionally, it may be possible to configure the actuation device 66 to pivot or otherwise actuate the drivetrain mounting plate 46 and upper pulley wheel 44 in alternate directions. For example, the actuation device 66 may be configured to pivot or otherwise actuate the drivetrain mounting plate 46 and upper pulley wheel 44 in a clockwise direction such that the front portion of the drivetrain mounting plate 46 may move downwards and backwards towards the rear portion 62 of the rotor assembly 30. However, it will be understood the drivetrain mounting plate 46 and upper pulley wheel 44, or other component of the rotor assembly 30 may be alternately configured in order to reduce the overall width of the rotor assembly 30 as needed.

Figure 4:
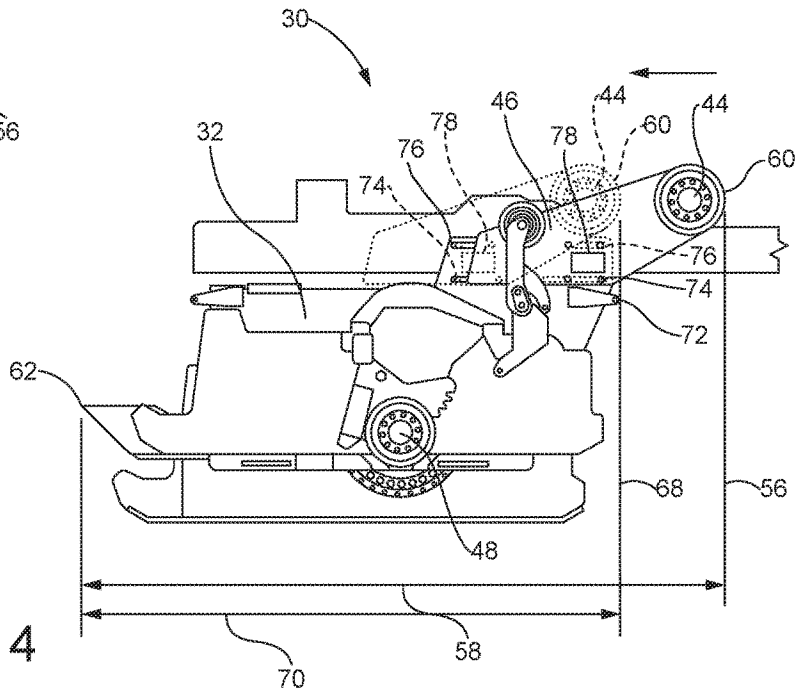
FIG. 4 is a side view of the rotor assembly actuated between an operation position and a transportation position, in accordance with an embodiment of the present disclosure.

Referring to FIG. 4, a side view of an alternative embodiment of the rotor assembly 30 is depicted. Similarly to the embodiment illustrated in FIG. 3, the rotor assembly 30 of FIG. 4 may be capable of being adjusted between one or more positions to increase or decrease a dimension or geometry of the rotor assembly 30 such as but not limited to, the width, length, height, or other dimension. For example, the drivetrain mounting plate 46 and the upper pulley wheel 44 may be adjusted into the operation position 56 of the rotor assembly 30. In the operation position 56, the drivetrain mounting plate 46 and the upper pulley wheel 44 may be positioned such that the front portion 60 of the drivetrain mounting plate 46 extends in the forward direction beyond the front portion 72 of the rotor chamber 32 to define the operation width 58 of the rotor assembly 30. Accordingly, the operation width 58 may be measured between the front portion 60 of the drivetrain mounting plate 46 and the upper pulley wheel 44 and the rear portion 62 of the rotor chamber 32, or any other such points to measure the operation width 58. In one non-limiting example, the operation width 58 measures approximately 3.4 meters, however other configurations of the rotor assembly 30 may provide an alternative operation width 58.

As further shown in FIG. 4, some embodiments of the rotor assembly 30 may include one or more plate actuation pins 74 on the drivetrain mounting plate 46 and a corresponding pin slot 76 on the rotor chamber 32. The plate actuation pins 74 may include a plurality of pins arranged in a linear formation along the drivetrain mounting plate 46 and the pin slot 76 may be configured as a horizontal slot or opening formed in a portion of the rotor chamber 32. Moreover, the plate actuation pins 74 and the pin slot 76 may be slidingly engaged with one another such that the plate actuation pins 74 slide along the pin slot 76. As a result, the drivetrain mounting plate 46 and upper pulley wheel 44 are configured to slide back and forth along a portion of the rotor chamber 32. Additionally, as shown in FIG. 4 the drivetrain mounting plate 46 may be configured with a multiple linear arrangements of the plate actuation pins 74 (i.e., upper and lower) and multiple corresponding pin slots 76 (i.e., upper and lower). However, it will be understood that plate actuation pins 74 and pin slots 76 may be alternately configured to provide actuation of the drivetrain mounting plate 46 and upper pulley wheel 44 as needed. Furthermore, the drivetrain mounting plate 46 and upper pulley wheel may be alternatively configured to slide along rails, sliders or other such device.

Moreover, an actuation device 78, such as but not limited to, a hydraulic actuator, a roller screw, or other such actuation device may be attached to the drivetrain mounting plate 46 and the rotor chamber 32. The actuation device may be configured to slide or otherwise actuate the drivetrain mounting plate 46 and the upper pulley wheel 44 along the drivetrain mounting plate actuation pins 74 and the pin slots 76. In one non-limiting example, the drivetrain mounting plate 46 and upper pulley wheel 44 may slide along the drivetrain mounting plate actuation pins 74 and the pin slots 76 to position the drivetrain mounting plate 46 and upper pulley wheel 44 in the operation position 56. In the operation position 56, the drivetrain mounting plate 46 and upper pulley wheel 44 may be positioned in a forward direction which extends beyond the front portion 72 of the rotor chamber 32 to thereby define the operation width 58 of the rotor assembly 30. Accordingly, the operation width 58 may be measured between the front portion 60 of the drivetrain mounting plate 46 and the rear portion 62 of the rotor chamber 32. However, the measurement may be made between alternative points of the rotor assembly 30 to define the operation width 58. In one non-limiting example the operation width 58 measures approximately 3.4 meters, however other configurations of the rotor assembly may provide an alternative operation width 58.

Alternatively, the actuation device 78 may be actuated such that the drivetrain mounting plate 46 and the upper pulley wheel 44 slide or otherwise move along the drivetrain mounting plate actuation pins 74 and the pin slots 76 to position the drivetrain mounting plate 46 and upper pulley wheel 44 in the transport position 68. In the transport position 68, the front portion 60 of the drivetrain mounting plate 46 and the upper pulley wheel 44 may slide back towards the rear portion 62 of the rotor assembly 30 such that the overall width of the rotor assembly 30 is reduced. For example, the drivetrain mounting plate 46 and upper pulley wheel 44 may slide back into the transport position 68 where the front portion 60 of the drivetrain mounting plate 46 is substantially even or flush with the front portion 72 of the rotor chamber 32. Alternatively, actuation of the drivetrain mounting plate 46 and upper pulley wheel 44 may slide the drivetrain mounting plate 46 and upper pulley wheel 44 in the rearward direction such that the front portion 60 of the drivetrain mounting plate 46 is positioned at an interior position relative to the front portion 72 of the rotor chamber 32. As a result, the transport position 68 may define the transport width 70 of the rotor assembly 30 measured between the front portion 72 of the rotor chamber 32 and the rear portion 62 of the rotor chamber 32. In some embodiments, the transport width 70 may measure 2.9 meters, approximately a 14% reduction in width relative to the operation width 58. However other transport widths 70 of the rotor assembly 30, and width reductions thereof are possible in order to configure the rotor assembly 30 to comply with transportation and shipping regulations.

It will be understood that the rotor assembly 30 may be alternatively configured to be manually actuated between the operation position 56 and the transport position 68 using known manual actuation devices and methods. For example, a handle may be positioned on the drivetrain mounting plate 46 which may allow an operator of the cold planer 20 to slide or otherwise adjust the drivetrain mounting plate 46 and upper pulley wheel 44 between positions.

Figure 5:
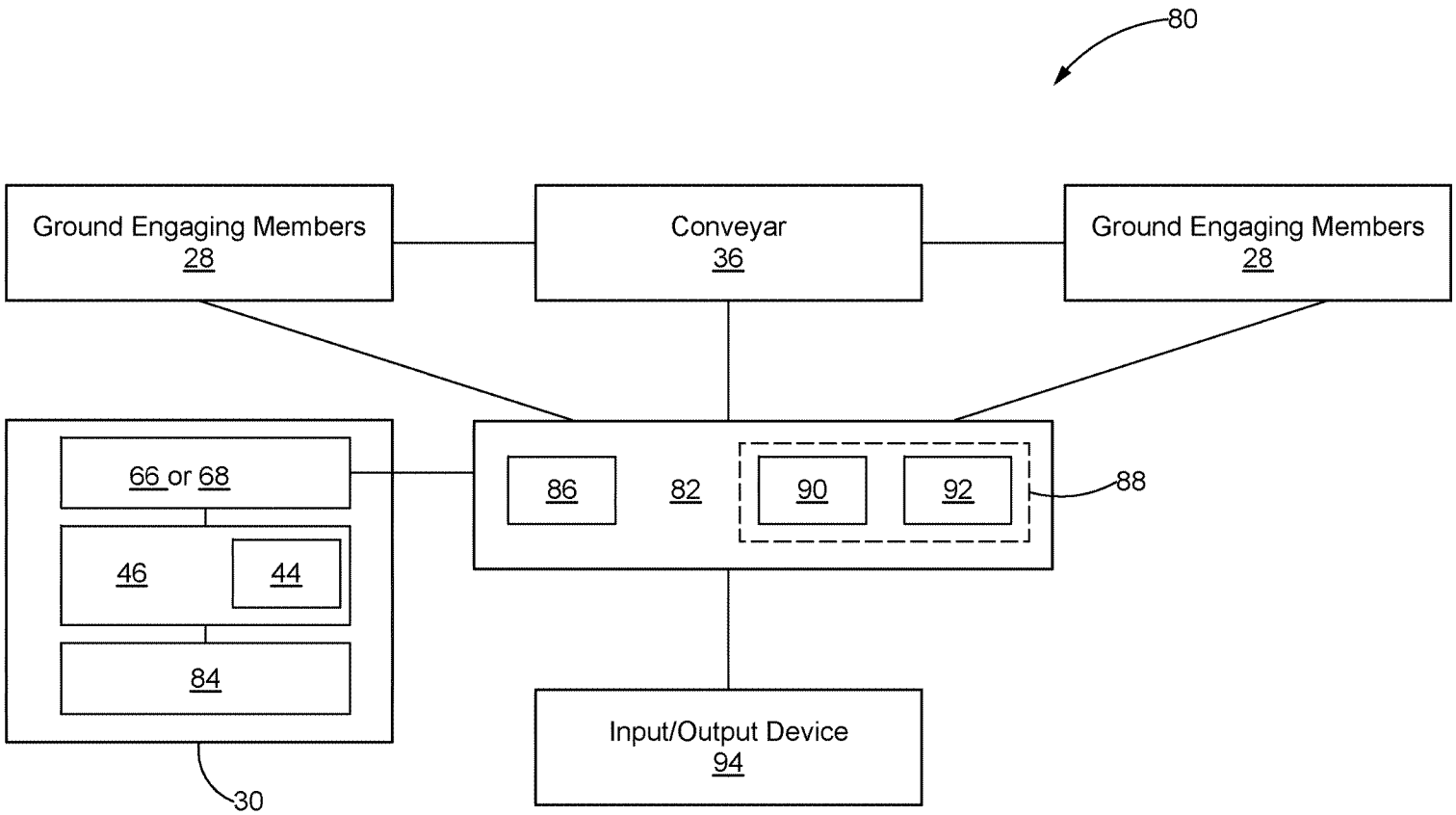
FIG. 5 is a schematic diagram of a control system for controlling the actuation of the rotor assembly, in accordance with an embodiment of the present disclosure.

Referring now to FIG. 5, and with continued reference to FIGS. 1-4, the cold planer 20 is shown to also include a control system 80 configured to provide actuation control of the rotor assembly 30 between the operation position 56, and the transport position 68. Furthermore, in some embodiments the control system 80 may provide actuation control of the rotor assembly 30 at an intermediate position between the operation and transport positions 56, 68. The control system 80 may include an electronic controller 82 programmed to receive data signals and other information from input devices, such as, at least one drivetrain mounting plate position sensor 84, and other components and input devices of the cold planer 20. In some embodiments, the electronic controller 82 is incorporated with the machine electronic control module configured to operate and control the cold planer 20. Alternatively, the electronic controller 82 may be dedicated to provide actuation control of the rotor assembly 30. The electronic controller 82 may be further configured to process the data signals and other information using software stored therein, and outputting information and commands to components and devices such as, the actuation devices 66, 78 the ground engaging members 28, the conveyor 36 or other machine implement and other output devices.

The electronic controller 82 may include a microprocessor 86 for executing software or other programs that control and monitor the various functions of the cold planer 20. Moreover, the microprocessor 86 may include a memory module 88 configured with read only memory (ROM) 90, which provides storage for the software and other data, and random access memory (RAM) 92, which provides storage space for data generated during the execution of the software. While the microprocessor 86 is shown, it will be appreciated that other components, such as, but not limited to, a microcontroller, an application specific integrated circuit (ASIC), or other electronic controlling device may be incorporated into the electronic controller 82 as well.

The electronic controller 82 may be housed within the operator platform 26 (FIG. 1) and further be coupled to an input/output device 94, such that an operator of the cold planer 20 can access the electronic controller 82. The input/output device 94 may be configured to allow the operator to input or execute commands through a keyboard, a mouse, a dial, a button, a joystick, a touch screen, a microphone, or other known input device. Additionally, data and other information provided by the electronic controller 82 may be output to a display device such as, a monitor, a speaker, a video screen, or other visual/audio display device that is capable of providing information output by the electronic controller 82 to the operator. In some embodiments, the input/output device 94 may be coupled to the electronic controller 82 through a wired connection. Alternatively, the input/output device 94 may be coupled to the electronic controller 82 through a wireless communication network such as a Bluetooth® network, a near-field communication network, a radio frequency communication network, a computer data network, a Wi-Fi data network, a cellular data network, a satellite data network, or other such data communication network. Furthermore, the input/output device 94 may be a handheld mobile device such as, a tablet computer, a smart phone, a cellular phone, or other mobile device that is wirelessly connected to the electronic controller 82. As a result, the operator and the input/output device 94 may be remotely located from the electronic controller 82 such that the operator can remotely control various functions of the cold planer 20 from a location other than the operator platform 26.

In operation of the cold planer 20, the control system 80 may be selected and programmed to operate in a first operation mode that is configured to control the actuation device 66, 78 and initiate movement of the drivetrain mounting plate 46 and upper pulley wheel 44 between the operation position 56 and the transport position 68. In some embodiments, the control system 80 may be selected and programmed to operate in a second operation mode which may provide an adjustment function of the belt 50 (FIG. 2) when the rotor assembly 30 is in the operation position 56. For example, the control system 80 may be configured to control small movements of the drivetrain mounting plate 46 and upper pulley wheel 44 to optimize the alignment of the belt 50 between the upper pulley wheel 44 and the lower pulley wheel 48. Additionally, the control system 80 may be further configured to adjust the belt tensioner 52 or other component of the rotor assembly 30 to adjust the tension of the belt 50.

To control the positioning of the drivetrain mounting plate 46 and upper pulley wheel 44 of the rotor assembly 30, the electronic controller 82 may be configured to monitor the position of the drivetrain mounting plate 46 and upper pulley wheel 44. In one embodiment, the drivetrain mounting plate 46 may be coupled to at least one drivetrain mounting plate position sensor 84 which monitors the position of the drivetrain mounting plate 46 and transmits a position signal to the electronic controller 82. As the drivetrain mounting plate 46 and upper pulley wheel 44 are actuated between the operation position 56 and transport position 68, the drivetrain mounting plate position sensor 84 transmits a position signal to the electronic controller 82. The electronic controller 82 receives the position signal and adjusts the actuation of the actuation device 66, 78, based on the received position signal. Additionally, the electronic controller 82 may be programmed to use the position signal from the at least one drivetrain mounting plate position sensor 84 to make small adjustments and/or alignments of the rotor assembly 30 when the drivetrain mounting plate 46 and upper pulley wheel 44 are in the operation position 56. For example, the electronic controller 82 may command the actuation device 66, 78 to move in small increments to align or otherwise adjust the belt 50 of the rotor assembly 30.

INDUSTRIAL APPLICABILITY

In general, the foregoing disclosure finds utility in cold planer machines used in the construction and resurfacing of roads and other paved surfaces. In some embodiments, the cold planer 20 includes a rotor assembly 30 that is capable of being adjusted or otherwise positioned to comply with certain transportation and/or shipping requirements. Generally, highways, expressways or other roadways are designed with a standard lane width such as but not limited to, approximately 3.7 meters. As a result, to maintain safety and limit excessive wear of the roadway, industrial equipment such as the cold planer 20 transported across the roadway from one location to another may need to comply with certain transportation requirements such as but not limited to, a maximum width, a maximum length, a maximum height, a maximum weight, or other shipment dimension and/or geometry requirement. In one non-limiting example, equipment being transported using highways, expressways or other such roadways, may be required to have a width of less than 3 meters. Such a width requirement may help ensure adequate distance between the transported load and adjacent lanes of the highway, expressway or other such roadway.

In some situations, equipment that is over the maximum width may still be transported using the highway, expressway or other such roadway by designating the transported load as a wide load or an oversized load. However, transportation costs may be significantly higher due to the need to obtain special permitting to transport wide or oversized loads. Furthermore, the wide load or oversized load may take longer to transport from one location to another, therefore increasing the idle time of the cold planer 20. Increased idle time of the cold planer 20 may increase the operation costs of the cold planer 20. Additionally, transportation of the wide load or oversized load may increase the possibility of damage to the equipment during transport. As a result, configuring the cold planer 20 to comply with the standard shipping regulations may provide several cost, safety and operational benefits.

The cold planer 20 of the present disclosure provides adjustable capabilities in order to comply with transportation and shipping regulations. In one non-limiting example, the cold planer 20 may include a rotor assembly 30 or other components that are collapsible and/or adjustable in order to comply with the transportation and shipping regulations. In one non-limiting example, the rotor assembly 30 may be detached from the frame 22 of the cold planer 20 for shipment to another location. Prior to detaching the rotor assembly 30, the belt 50 may be untensioned and removed from the upper pulley wheel 44 and the lower pulley wheel 48. In some embodiments, the cold planer 20 may include a plurality of belts which need to be removed prior to removal of the rotor assembly 30. Following the removal of the belt 50, or plurality of belts, the upper pulley wheel 44 may be decoupled or otherwise disconnected from the power source 24. In some embodiments, the upper pulley wheel 44 is coupled to the power source 24 by the drive shaft 54. Therefore, the drive shaft 54 may need to be unbolted or otherwise unfastened to decouple the upper pulley wheel 44 from the drive shaft 54.

Following removal of the drive shaft 54, the operator of the cold planer 20 may operate the control system 80 to further prepare the rotor assembly 30 for transportation. The operator may actuate the actuation device 66, 78 to move the drivetrain mounting plate 46 and upper pulley wheel 44 from the operation position 56 to the transport position 68. When doing so, the operator may operate the control system 80 from the operator platform 26 of the cold planer 20. Alternatively, the operator may operate the control system 80 from a set of controls placed on or adjacent to the rotor assembly 30. Moreover, in some cases, the operator may be wirelessly connected to the control system 80 and as a result, the operator may have a wirelessly connected input/output device 94, such as but not limited to a smart phone or tablet computer that is capable of controlling the control system 80. As a result, the operator may use the wirelessly connected input/output device 94 to operate the control system 80 from a remote location. Additionally, it will be understood that the drivetrain mounting plate 46 and upper pulley wheel 44 may be configured to be manually moved by the operator without use of the control system 80 to prepare the rotor assembly 30 for transportation.

When the operator activates the actuation device 66, the drivetrain mounting plate 46 and upper pulley wheel 44 are caused to pivot or otherwise rotate from the operation position 56 to the transport position 68. In one embodiment, the drivetrain mounting plate 46 is attached to the rotor chamber 32 at a pivot joint 64 and the actuation device 66 is configured to pivot the drivetrain mounting plate 46 and upper pulley wheel 44 in a counterclockwise direction. Moreover, the actuation device 66 may be configured to lock and hold the drivetrain mounting plate 46 and upper pulley wheel 44 in an upright position. As a result, the drivetrain mounting plate 46 and upper pulley wheel 44 are maintained in the transport position 68. The resulting transport position 68 is thus configured to provide a reduced overall width for the rotor assembly 30. In some embodiments, the reduced overall width of the rotor assembly 30 complies with shipping and transportation regulations such that the rotor assembly 30 and other components of the cold planer 20 may be transported using highways, expressways, and other roadways without the need for special permitting to account for the oversized load.

In an alternative embodiment, the operator activates the actuation device 78 which causes the drivetrain mounting plate 46 and upper pulley wheel 44 to slide back towards the rear portion 62 of the rotor assembly 30. The drivetrain mounting plate 46 may be configured with a set of drivetrain mounting plate actuation pins 74 and the rotor chamber 32 may be configured with a complementary set of pin slots 76. Moreover, the actuation device 78 may be configured to linearly slide the drivetrain mounting plate 46 and upper pulley wheel 44 from the operation position 56 to the transport position 68 and the actuation device 78 maintains the drivetrain mounting plate 46 and upper pulley wheel 44 in the transport position 68. As mentioned above, the transport position 68 is configured to provide a reduced overall width of the rotor assembly 30.

Once the rotor assembly 30 is placed in the transport position 68, the rotor assembly 30 may be detached from the frame 22 or other component of the cold planer 20. In one non-limiting example the rotor assembly 30 is attached to the frame 22 using one or more attachment devices, such as but not limited to a bolt, screw, pin or other such device, inserted through the frame attachment bracket 42 and the rotor attachment bracket 40. As a result, removing the one or more attachment devices will detach the rotor assembly 30 from the frame 22 of the cold planer 20. Additionally, there may be other machine connections to the control system 80, the actuation device 66, 78, or other systems and components of the cold planer 20 which may be disconnected when detaching the rotor assembly 30 from the frame 22 of the cold planer 20.

After the rotor assembly 30 is positioned in the transport position 68 and detached from the frame 22 of the cold planer 20 the rotor assembly 30 may be loaded onto a trailer or other transportation vehicle to transport the rotor assembly 30 to a new location. In some embodiments, the transport position 68 reduces the overall width of the rotor assembly 30 such that the rotor assembly 30 may be oriented lengthwise on the trailer and shipped without requiring any special transportation permits. In one non-limiting example, the rotor assembly 30 may have the operation width 58 of 3.4 meters reduced to the transport width 70 of 2.9 meters. As such, the width of the rotor assembly 30 in the transport position 68 is reduced to at least 2.9 meters, and the width of the rotor assembly 30 in the transport position 68 is configured to comply with a transportation standard for transporting the cold planer 20. In so doing, the cold planer 20 provides the width needed and desired by the industry to efficiently perform its work tasks and to reduce its transportation footprint to comply with standard industry transportation regulations. However, it will be understood that the transport width 70 of the rotor assembly 30 may be configured to provide an alternative transport width 70 to comply with alternative transportation regulations.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A rotor assembly for a cold planer, the rotor assembly comprising:

a rotor chamber configured to house a milling drum, the milling drum configured to rotate within the rotor chamber;

a plate movably coupled to the rotor chamber;

an upper pulley wheel rotatably mounted to the plate;

a lower pulley wheel rotatably mounted to the rotor chamber and operably coupled to the milling drum such that the lower pulley wheel and the milling drum synchronously rotate; and an actuating mechanism operably coupled to the plate and the rotor chamber, and the actuating mechanism configured to move the plate and the upper pulley wheel between an operation position that defines a first rotor assembly width and a transport position that defines a second rotor assembly width that is less than the first rotor assembly width.

2. The rotor assembly of claim 1, wherein the actuating mechanism includes at least one hydraulic actuator operably coupled to the plate and the rotor chamber, and the at least one hydraulic actuator being configured to operate in a first actuation mode to move the plate between the operation position and the transport position.

3. The rotor assembly of claim 2, further comprising a belt which couples the upper pulley wheel with the lower pulley wheel, and wherein the at least one hydraulic actuator being further configured to operate in a second actuation mode when the plate is in the operation position such that the second actuation mode moves the plate in small increments to adjust an alignment between the upper pulley wheel and a drive shaft of the cold planer prior to installing the belt on the upper pulley wheel and the lower pulley wheel.

4. The rotor assembly of claim 1, wherein the plate being movably coupled to the rotor chamber further comprises the plate being coupled to the rotor chamber at a pivot joint and the actuating mechanism configured to pivot the plate about the pivot joint between the operation position and the transport position.

5. The rotor assembly of claim 1, wherein the plate being movably coupled to the rotor chamber further comprises a set of pins formed on the plate and an opposing set of slots formed on the rotor chamber, the set of pins being slidably engaged with the opposing set of slots, and the actuating mechanism being configured to slide the plate along the set of pins and the set of slots between the operation position and the transport position.

6. The rotor assembly of claim 1, wherein the actuating mechanism is configured to move the plate and the upper pulley wheel from the operation position to the transport position and the actuating mechanism is further configured to lock the plate and upper pulley wheel in the transport position.

7. The rotor assembly of claim 6, wherein the transport position reduces a width of the rotor assembly, and the width of the rotor assembly in the transport position is configured to comply with a transportation standard for transporting the rotor assembly.

8. A cold planer, comprising:

a frame;

a rotor assembly removably attached to the frame, the rotor assembly including;

a rotor chamber configured to house a milling drum, and the milling drum configured to rotate within the rotor chamber;

a plate movably coupled to the rotor chamber;

an upper pulley wheel rotatably mounted to the plate;

a lower pulley wheel rotatably mounted to the rotor chamber and operably coupled to the milling drum such that the lower pulley wheel and the milling drum synchronously rotate;

an actuating mechanism operably coupled to the plate and the rotor chamber, and the actuating mechanism configured to move the plate and the upper pulley wheel between an operation position that defines a first rotor assembly width and a transport position that defines a second rotor assembly width that is less than the first rotor assembly width; and a controller communicably coupled with the actuating mechanism and configured to transmit a control signal to the actuating mechanism wherein the transmitted control signal activates the actuating mechanism to move the plate and the upper pulley wheel between the operation position and the transport position.

9. The cold planer of claim 8, wherein the actuating mechanism includes at least one hydraulic actuator operably coupled to the plate and the rotor chamber, and the controller is configured to operate the at least one hydraulic actuator in a first actuation mode to move the plate between the operation position and the transport position.

10. The cold planer of claim 9, further comprising a belt which couples the upper pulley wheel with the lower pulley wheel, and wherein the controller is further configured to operate the at least one hydraulic actuator in a second actuation mode when the plate is in the operation position such that the second actuation mode moves the plate in small increments to adjust an alignment between the upper pulley wheel and a drive shaft of the cold planer prior to installing the belt on the upper pulley wheel and the lower pulley wheel.

11. The cold planer of claim 8, wherein the plate being movably coupled to the rotor chamber further comprises a pivot joint rotatably coupling the plate to the rotor chamber and the actuating mechanism configured to rotate the plate about the pivot joint between the operation position and the transport position.

12. The cold planer of claim 8, wherein the plate being movably coupled to the rotor chamber further comprises at set of pins formed on the plate and an opposing set of slots formed on the rotor chamber, the set of pins being slidably engaged with the opposing set of slots, and the actuating mechanism being configured to slide the plate along the set of pins and the set of slots between the operation position and the transport position.

13. The cold planer of claim 8, wherein the actuating mechanism is configured to move the plate and the upper pulley wheel from the operation position to the transport position and the actuating mechanism is further configured to lock the plate and upper pulley wheel in the transport position.

14. The cold planer of claim 13, wherein the width of the rotor assembly in the transport position is reduced to at least 2.9 meters, and the width of the rotor assembly in the transport position is configured to comply with a transportation standard for transporting the cold planer.

15. A method of transporting a cold planer having a rotor assembly, the method comprising:

removing a belt from an upper pulley wheel and a lower pulley wheel of the rotor assembly, the upper pulley wheel rotatably coupled to a plate;

decoupling a drive shaft from the upper pulley wheel thereby disconnecting the upper pulley wheel from a power source of the cold planer;

activating an actuating mechanism to move the plate and the upper pulley wheel from an operation position to a transport position, wherein the operation position defines a first rotor assembly width and the transport position defines a second rotor assembly width that is less than the first rotor assembly width;

locking the plate and the upper pulley wheel in the transport position, wherein the actuating mechanism is configured to lock and hold the plate and the upper pulley wheel in the transport position;

removing a plurality of attachment devices from a rotor chamber thereby decoupling the rotor assembly from the cold planer; and loading the rotor assembly for transport to a desired location.

16. The method of claim 15, wherein the actuating mechanism includes at least one hydraulic actuator coupled to the plate and the rotor chamber, and activating the actuating mechanism includes operating the at least one hydraulic actuator in a first actuation mode to move the plate between the operation position and the transport position.

17. The method of claim 15, wherein a pivot joint rotatably couples the plate to the rotor chamber, and activating the actuating mechanism rotates the plate about the pivot joint between the operation position and the transportation position.

18. The method of claim 15, wherein a set of pins formed on the plate is slidably engaged with an opposing set of slots formed on the rotor chamber, and actuating the actuating mechanism slides the plate along the set of pins and the set of slots between the operation position and the transport position.

19. The method of claim 15, wherein activating the actuating mechanism to move the plate and the upper pulley wheel from the operation position into the transport position reduces a width of the rotor assembly to at least 2.9 meters.

20. The method of claim 19, wherein loading the rotor assembly for transport includes positioning the rotor assembly lengthwise such that the width of the rotor assembly complies with a transportation standard for transporting the cold planer.

* * * * *